US006131400A

United States Patent [19]

Seok et al.

[11] Patent Number: 6,131,400

[45] Date of Patent: Oct. 17, 2000

[54] OPERATION CONTROL METHOD FOR A REFRIGERATOR IN CASE OF A POWER-SUPPLY COMEBACK AFTER A POWER-FAILURE

[75] Inventors: Jin-Oh Seok; Yun-Seog Kang, both of Kwangju, Rep. of Korea

[73] Assignee: Samsung Electronics Co., Ltd., Suwon, Rep. of Korea

[21] Appl. No.: 09/394,673

[22] Filed: Sep. 13, 1999

[30] Foreign Application Priority Data

Sep. 16, 1998 [KR] Rep. of Korea ..... 98-38267

[51] Int. Cl.[7] ..... F25B 49/02

[52] U.S. Cl. ..... 62/154; 62/155; 62/156; 62/230

[58] Field of Search ..... 62/155, 156, 230, 62/234, 151, 154

[56] References Cited

U.S. PATENT DOCUMENTS

| | | | |
|---|---|---|---|
| 4,299,095 | 11/1981 | Cassarino | 62/155 |
| 5,295,361 | 3/1994 | Novak et al. | 62/156 X |
| 5,363,669 | 11/1994 | Janke et al. | 62/155 |

FOREIGN PATENT DOCUMENTS 10-9687 1/1998 Japan .

*Primary Examiner*—Harry B. Tanner
*Attorney, Agent, or Firm*—Larson & Taylor

[57] ABSTRACT

An operation control method for a refrigerator after a power-supply comeback due to a power-failure that performs a re-operation according to operation information stored before the power-failure. The operation control method includes the steps of: (a) reading stored operation information when power is reapplied to the refrigerator; (b) determining whether the operation information includes a compartment set temperature information and an accumulated information of a compressor operation time; (c) if the compartment set temperature information and the accumulated information of the compressor operation time are found in the step (b), automatically setting an operation mode according to the compartment set temperature information, and detecting a compartment temperature of the refrigerator and an evaporator surface temperature; (d) determining whether the compartment temperature is lower than a predetermined compartment temperature to determine a power failure of a long time, or the evaporator surface temperature is lower than a predetermined surface temperature to determine a power-failure of a long time; (e) if the compartment temperature is lower than the predetermined compartment temperature or the evaporator surface temperature is lower than the predetermined surface temperature in the step (d), accumulating a compressor operation time in addition to the stored compressor operation time; and (f) if the compartment temperature is not lower than the predetermined compartment temperature and the evaporator surface temperature is not lower than the predetermined surface temperature in the step (d), deleting the stored compressor operation time accumulation information, and newly accumulating a compressor operation time.

4 Claims, 3 Drawing Sheets

OPERATION CONTROL METHOD FOR A REFRIGERATOR IN CASE OF A POWER-SUPPLY COMEBACK AFTER A POWER-FAILURE

BACKGROUND OF THE INVENTION (1) Field of the Invention

The present invention relates to an operation control method for a refrigerator. More particularly, it related to an operation control method for a refrigerator in case of a power-supply comeback after a power-failure, which performs a re-operation according to an operation information stored before the power-failure if a power-supply is applied again to the refrigerator after a power-failure.

(2) Description of the Prior Art

Generally, a refrigerator having two evaporators includes two cooling fans for discharging a cool air generated from the evaporators into a freezing compartment and a refrigerating compartment, and a compressor mounted to a lower part of the refrigerator. One of the two cooling fans is mounted in the freezing compartment, and the other one is mounted in the refrigerating compartment. A controller controls on/off operations of the compressor and the freezing and refrigerating fans according to a comparison result between each compartment temperature and each compartment set temperature.

An operation control method for a prior refrigerator will be described with reference to FIG. 1.

Referring to FIG. 1, after a power-supply is applied to the refrigerator (S1), a controller determines (S2) whether or not an operation mode is determine by the user.

If the operation mode is not determined by the user in the step S2, a controller starts (S3) a cooling operation according to a standard cooling operation mode among a plurality of pre-programmed operation modes. But, if the operation mode is determined by the user in the step S2, the controller starts (S4) a cooling operation according to a user-set operation mode.

A cooling operation of the refrigerator starts in the step S3 or the step S4, the controller accumulates a compressor operation time by using a time accumulator (not shown).

After that, the controller determines (S6) whether the accumulated operation time of the compressor reaches a reference time being set for a defrosting operation. Namely, the controller determines whether or not a defrosting operation condition is provided in the step S6.

If the defrosting operation condition is provided in the step S6, a defrosting operation by a heater starts (S7).

After the step S7, the controller determines (S8) whether or not the defrosting operation is completed by using an evaporator's temperature or a heater's driving time.

If the step S8 determines that the defrosting operation is completed, a present accumulated compressor operation time is deleted (S9), and then the step S9 returns to the step S4.

However, in the prior refrigerator, if a power-supply is applied again to the refrigerator after the power-supply to the refrigerator is suddenly cut off due to a power-failure, an operation mode being set before the power-failure and a compressor operation time being accumulated before the power-failure are all deleted, a standard cooling operation mode which sets a compartment set temperature to a middle level automatically starts, so that the user should newly set a desired cooling operation mode.

In other words, if a power-failure occurs while the prior refrigerator is driven by a strong cooling operation mode and then a power-supply is applied again to the refrigerator, a standard cooling operation mode not the strong cooling operation mode automatically starts, so that a cooling capacity becomes lower than an original operation mode being the strong cooling operation mode. In addition, if the prior refrigerator is driven by a weak cooling operation mode before the power-failure, the standard cooling operation mode not the weak cooling operation mode automatically starts after a power-supply comeback, so that a cooling capacity becomes stronger than an original operation mode being the weak cooling operation mode.

Further, since an initial defrosting operation makes an evaporator be easily frozen because of air having much moisture, a defrosting period of the initial defrosting operation is set to be shorter than that of a normal defrosting operation in a cooling operation, In this case, if a power-supply is applied again to the refrigerator after a power-failure, since a compressor operation time accumulated before the power-failure is deleted, a defrosting operation is always achieved by the defrosting period of the initial defrosting operation.

Therefore, if a power-failure frequently occurs owing to unstable power-supply or a thunderstorm, the number of the defrosting, operation becomes increased due to a frequent re-operation of the refrigerator, As a result, a temperature of each compartment becomes also increased, a cooling capacity becomes lowered.

SUMMARY OF THE INVENTION

Accordingly, the present invention is directed to an operation control method for a refrigerator in case of a power-supply comeback after a power-failure, that substantially obviates one or more of the problems due to limitations and disadvantages of the related art.

It is an objective of the present invention to provide an operation control method for a refrigerator in case of a power-supply comeback after a power-failure, which performs a re-operation according to an operation information stored before the power-failure if a power-supply is applied again to the refrigerator owing to a power-failure, thereby constantly maintaining a cooling capacity of a refrigerator even if the power-failure occurs.

To achieve the above objective, in an operation control method for a refrigerator which stores an operation information of the refrigerator into an information storage part, and performs a cooling operation and a defrosting operation according to the stored operation information, an operation control method for a refrigerator includes the steps of:

(a) reading an operation information restored in the information storage part if a power-supply is applied to the refrigerator;

(b) determining whether or not the operation information includes a compartment set temperature information and an accumulated information of a compressor operation time;

(c) if the compartment set temperature information and the accumulated information of the compressor operation time are in the step (b), automatically setting an operation mode according to the compartment set temperature information, and detecting a compartment temperature of the refrigerator and an evaporator surface temperature;

(d) determining whether the compartment temperature is lower than a predetermined compartment temperature to determine a power-failure of a long time, or the evaporator surface temperature is lower than a predetermined surface temperature to determine a power-failure of a long time;

(e) if the compartment temperature is lower than the predetermined compartment temperature or the evaporator surface temperature is lower than the predetermined surface temperature in the step (d), accumulating a compressor operation time in addition to the compressor operation time stored in the information storage part; and (f) if the compartment temperature is not lower than the predetermined compartment temperature and the evaporator surface temperature is not lower than the predetermined surface temperature in the step (d), deleting the compressor operation time accumulation information stored in the information storage part, and newly accumulating pa compressor operation time.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

Figure 1:
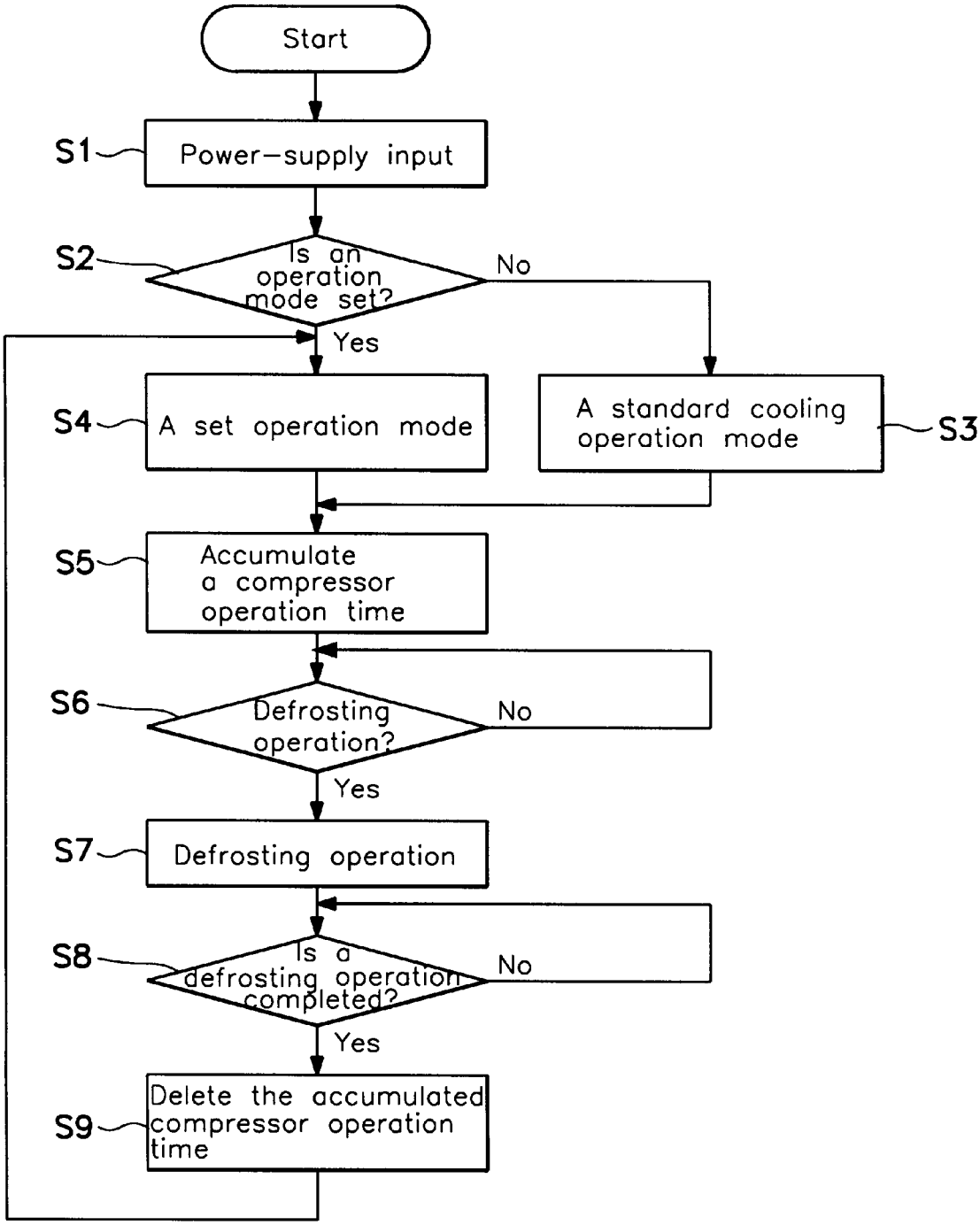
FIG. 1 (PRIOR ART)
FIG. 1 is a flowchart illustrating an operation control method of a prior refrigerator.
Figure 2:
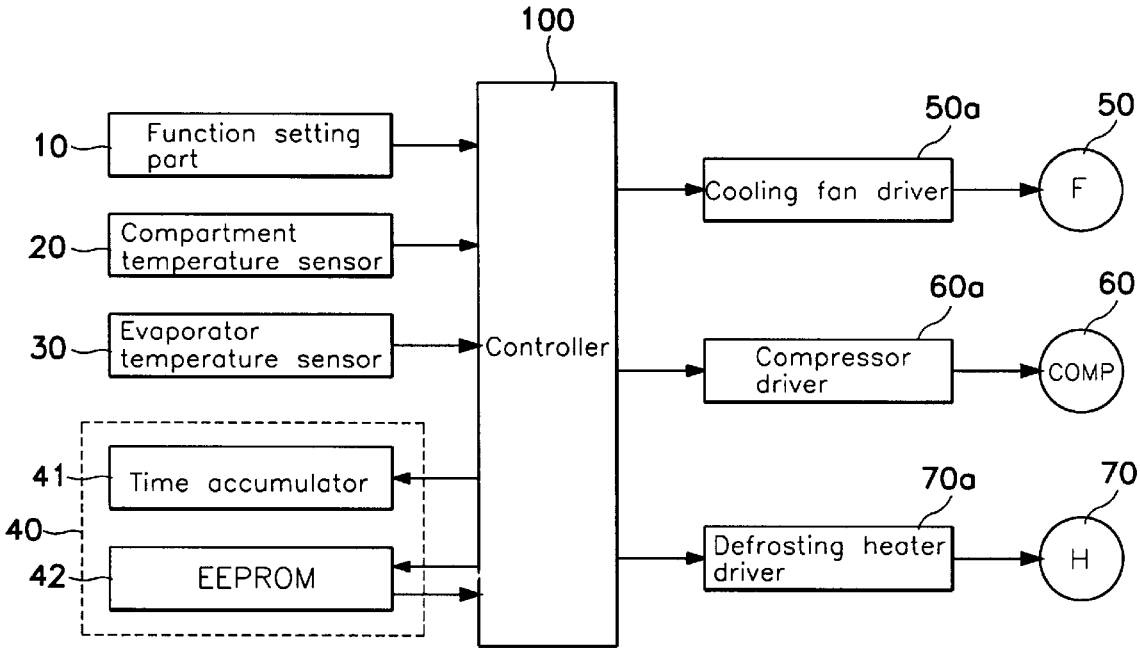
FIG. 2 is a block diagram of a refrigerator according to the present invention.

The preferred embodiments of the present invention will now be described in detail with reference to the accompanying drawings;

FIG. 2 is a block diagram of a refrigerator according to the present invention.

As shown in FIG. 2, the refrigerator includes: a function setting part 10 which is provided to a body, an selects a freezing compartment set temperature and a refrigerating compartment set temperature by a user; a compartment temperature sensor 20 which is mounted into each compartment in order to detect a freezing compartment temperature and a refrigerating compartment temperature; a cooling fan 50 which is mounted into each compartment in order to discharge a cool air generated form each evaporator mounted into each compartment; a cooling fan driver 50*a* for outputting a driving signal to the cooling fan 50; a compressor 60 for compressing a refrigerant, and providing the refrigerant to the evaporator; a compressor driver 60*a* for outputting a driving signal to the compressor 60; a defrosting heater 70 which is mounted to a surface of the evaporator in order to remove a frost formed on the evaporator surface; a defrosting heater driving part 70*a* of outputting a driving signal to the defrosting heater 70; and an evaporator temperature sensor 30 for sensing a surface temperature of the evaporator.

The refrigerator further includes: an information storage part 40 for storing an operation information such as a compressor operation time accumulation information before a power-failure, a compartment set temperature, and a current compartment temperature, and a controller 100 for controlling a normal operation of the refrigerator, and effectively performing a cooling operation and a defrosting operation about each compartment after a power-supply comeback if a power-failure occurs.

The information storage part 40 includes: a time accumulator 41 for accumulating a compressor operation time; and an EEPROM (Electrically Erasable and Programmable ROM) 42 for storing an operation information such as a compressor operation time accumulation information, each compartment set temperature determined by the function setting part 10, and a current compartment temperature.

The EEPROM 42 is a non-volatile memory, the non-volatile memory maintains the stored date even if the power is cut off. The EEPROM 42 is a fixed memory device for recording or removing the information by using an electrical means.

An operation control method fo a refrigerator after a power-failure will now be described with reference to FIG. 3

Figure 3:
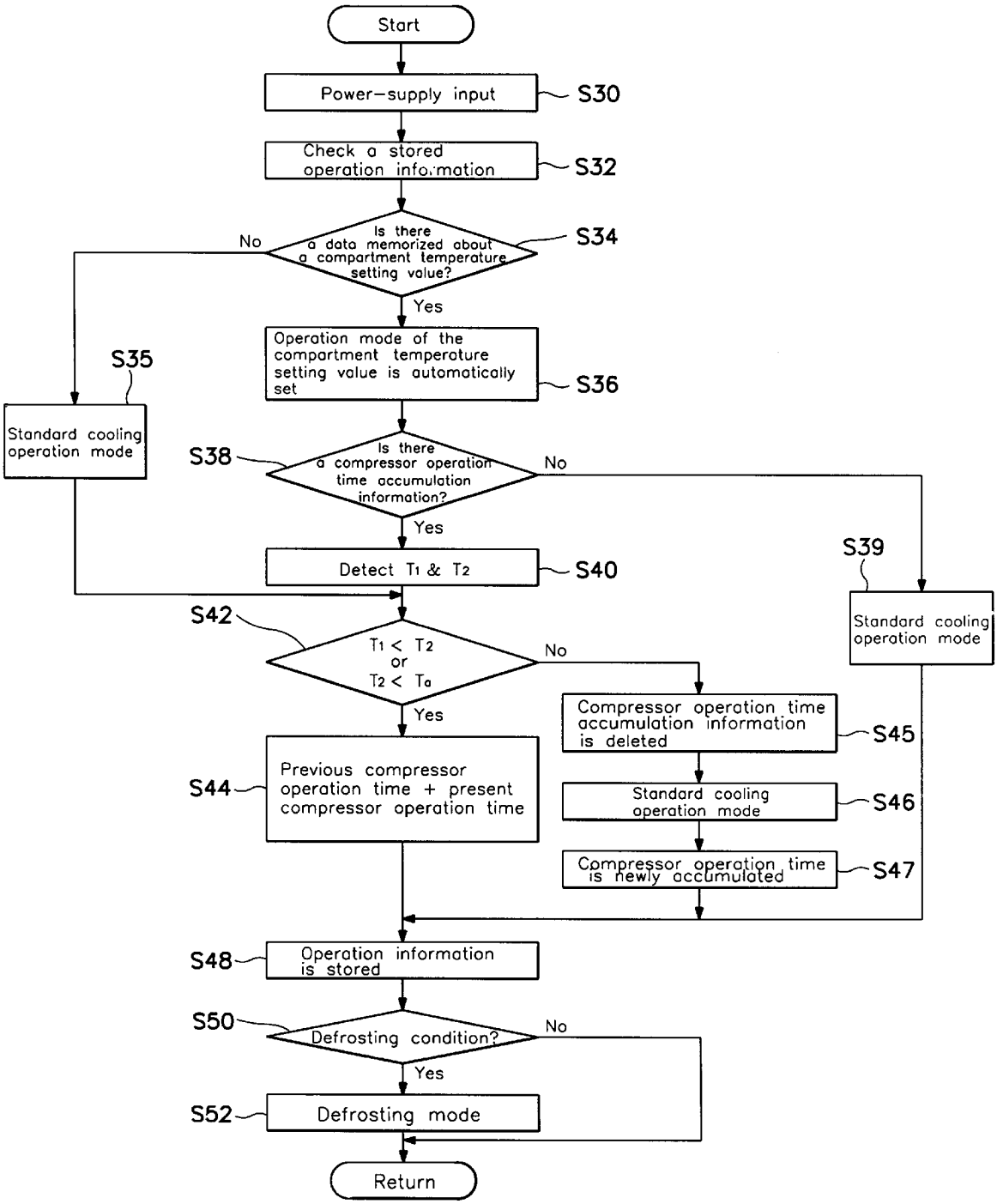
FIG. 3 is a flowchart illustrating an operation control method of a refrigerator if a power-failure occurs.

FIG. 3 is a flowchart illustrating an operation control method fo a refrigerator if a power-failure occurs.

As shown in FIG. 3, if a power-supply is applied to the refrigerator after a power-failure (S30), a controller 100 checks an operation information stored in the EEPROM 42 of the information storage part 40 (S32), and checks whether there is a data memorize about a compartment temperature setting value among the stored operation information of the EEPROM 42 (S34).

If the date memorized abut the compartment temperature setting value is in the step S34, an operation mode according to the compartment temperature setting value is automatically set (S36).

On the contrary, if there is no data memorized about the compartment temperature setting value in the step S34, this means an initial operation time point after the refrigerator is manufactured. At this time, the controller 100 determines a compartment temperature setting value as a 'middle' (S35), and performs a standard cooling operation mode of a refrigerator.

After that, the controller 100 determines whether there is a compressor operation time accumulation information in the stored operation information of the EEPROM 42 (S38).

If the compressor operation time accumulation information is not in the step S38, this means an initial operation time point of the refrigerator after the refrigerator is manufactured. At this time, the refrigerator after the refrigerator is manufactured. At this time, the refrigerator performs (S39) a standard cooling operation mode according to the compartment set temperature value 'middle' determined in the step S35, and accumulates a compressor operation time.

However, if the compressor operation time accumulation information is in the step S38, this means a re-operation of the refrigerator after a power-failure.

Accordingly, the controller 100 detects (S40) a compartment temperature T1 and an evaporator surface temperature T2 by using a compartment temperature sensor 20 and an evaporator temperature sensor 30, and compares (S42) each temperature T1 and T2 with each reference temperature T and Ta.

In the step S42, the controller 100 determines whether the compartment temperature T1 is lower than the reference temperature T (e.g., 2° C.) to determine a power-failure of along time, or the evaporator surface temperature T2 is lower than the reference surface temperature (e.g., 0° C.). Each reference temperature T and Ta is determined as an appropriate temperature in order to naturally perform a defrosting operation without using a defrosting means such as a heater.

If the compartment temperature T1 is lower than the reference temperature T or the evaporator surface temperature is lower than the reference surface temperature Ta in the step S42, the controller 100 determines that a power-failure of a short time within a few minutes occurs. When performing a cooling operation according to the operation mode of the step S36, the step S44 accumulates a compressor operation time in addition to a compressor operation time accumulation information stored before the power-failure, and stores (S48) the accumulated compressor operation time into the EEPROM 42.

However, if the compartment temperature T1 is not lower than the reference temperature T and the evaporator surface temperature is to lower than the reference surface temperature Ta in the step S42, the controller 100 determines that a power-failure of a long time occurs, deletes (S45) the compressor operation time accumulation time stored in the EEPROM 42, starts (S46) a standard cooling operation mode, newly accumulates (S47) a compressor operation time, and stores the newly accumulated compressor operation time into the EEPROM 42.

In other words, that two conditions are not satisfied in the step S42 means a status that a frost of an evaporator surface is naturally removed by a power-failure of a long time, thus an additional defrosting operation is not needed. As a result, the step S45 deletes the accumulated compressor operation time before a power-failure.

In addition to the step S44 or the step S47, the step S48 checks (S50) whether a defrosting condition is provided on the basis of the accumulated compressor operation time store in the EEPROM 42.

That is, if a normal defrosting period is determined as 10 hours on the basis of the accumulated compressor operation time, the controller 100 determines that a defrosting condition is provided when the total compressor operation time reached 10 hours in the step S50, and goes to the step S52. In the step S52, the controller 100 performs a defrosting operation by using a heater 70.

The aforementioned present invention can be preferably used in an electric appliance which always maintains a power-on state, for example, a vending machine or a water purifier, etc. A previous operation information of the electric appliance is not deleted after a power-failure. After the power-supply comeback, the electric appliance is operated on the basis of the operation information being set before the power-failure.

As described above, an operation control method for a refrigerator according to the present invention performs a re-operation according to an operation information stored before the power-failure if a power-supply is applied again to the refrigerator owing to a power-failure, and prevents a compartment set temperature variation caused by a power-failure. Also, since the present invention accumulates a compressor operation time in consideration of a natural defrosting caused by a power-failure, the present invention prevents that an unnecessary defrosting operation is frequently performed because of a frequent power-failure, and reduces a power-consumption.

It is understood that various other modifications will be apparent to an can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed:

1. In an operation control method for a refrigerator which stores an operation information of the refrigerator into an information storage part, and performs a cooling operation and a defrosting operation according to the stored operation information, the operation control method for a refrigerator, comprising the steps of:

(a) reading an operation information stored in the information storage part if a power-supply is applied to the refrigerator;

(b) determining whether or not the operation information includes a compartment set temperature information and an accumulated information of a compressor operation time;

(c) if the compartment set temperature information and the accumulated information of the compressor operation time are in the (b), automatically setting an operation mode according to the compartment set temperature information, and detecting a compartment temperature fo the refrigerator and an evaporator surface temperature;

(d) determining whether the compartment temperature is lower than a predetermined compartment temperature to determine a power-failure of a long time, or the evaporator surface temperature is lower than a predetermined surface temperature to determine a power-failure of a long time;

(e) if the compartment temperature is lower than the predetermined compartment temperature or the evaporator surface temperature is lower than the predetermined surface temperature in the step (d), accumulating an compressor operation time in addition to the compressor operation time stored in the information storage part; and (f) if the compartment temperature is not lower than the predetermined compartment temperature and the evaporator surface temperature is not lower than the predetermined surface temperature in the step (d), deleting the compressor operation time accumulation information stored in the information storage part, and newly accumulating a compressor operation time.

2. An operation control method for a refrigerator according to claim 1, further comprising the step of:

if the compartment set temperature information and the accumulated information of a compressor operation time are not in the operation information in the step (b), performing a cooling operation according to a standard operation mode setting a compartment set temperature as a 'middle'.

3. An operation control method for a refrigerator according to claim 1, further comprising the step of:

if the compressor operation time successively accumulated in the step (e) reaches a predetermined time, performing a defrosting operation.

4. An operation control method for a refrigerator according to claim 1, further comprising the step of:

if the compressor operation time newly accumulated in the step (f) reached a predetermined time, performing a defrosting operation.

* * * * *